US006403545B1

(12) United States Patent
Karls et al.

(10) Patent No.: US 6,403,545 B1
(45) Date of Patent: Jun. 11, 2002

(54) METHOD TO RENDER A HARD SURFACE HYDROPHILIC

(75) Inventors: Joseph F. Karls, Racine; John A. Sramek, Village of Wind Point, both of WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/266,404

(22) Filed: Mar. 10, 1999

(51) Int. Cl.[7] ..... C11D 3/20; C11D 3/26; C11D 3/37

(52) U.S. Cl. ..... 510/181; 510/182; 510/421; 510/476; 510/480; 510/506

(58) Field of Search ..... 510/180, 181, 510/182, 421, 476, 480, 506; 428/441

(56) References Cited

U.S. PATENT DOCUMENTS

| | | | | |
|---|---|---|---|---|
| 4,826,618 | A | 5/1989 | Borseth et al. | 252/174.21 |
| 4,874,604 | A | 10/1989 | Sramek | 424/47 |
| RE34,157 | E | 1/1993 | Sramek | 424/47 |
| 5,308,530 | A | 5/1994 | Aronson et al. | 252/174.12 |
| 5,534,198 | A | 7/1996 | Masters et al. | 510/182 |
| 5,648,326 | A | 7/1997 | Sramek | 510/284 |
| 5,652,208 | A | 7/1997 | Sramek | 510/284 |
| 5,705,470 | A | 1/1998 | Faris | 510/403 |
| 5,716,921 | A | 2/1998 | Neumiller | 510/181 |
| 5,750,482 | A | 5/1998 | Cummings | 510/182 |

FOREIGN PATENT DOCUMENTS

| | | |
|---|---|---|
| EP | 0 467 472 A2 | 7/1991 |
| EP | 0 565 950 A1 | 3/1993 |
| WO | WO 96/09368 | 3/1996 |
| WO | WO 97/38076 | 10/1997 |

*Primary Examiner*—D. S. Nakarani

(57) ABSTRACT

A composition, that imparts or enhances hydrophilic properties to a surface on which the composition is applied, comprises i) an associative polymeric thickening agent; and ii) a compound represented by the chemical structure:

(I)

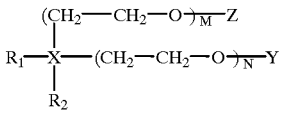

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkane or alkene substituent, or nothing; $R_2$=H, $CH_3$, $C_2H_5$, a branched or unbranched $C_{8-22}$ alkane or alkene substituent, O, or nothing; X=N, O, S, P, Si, $PO_3$, or $SO_3$; and Y=$R_2$ when N=0.

30 Claims, No Drawings

METHOD TO RENDER A HARD SURFACE HYDROPHILIC

FIELD OF THE INVENTION

The present invention relates to a method of imparting or enhancing of anti-fog and anti-static properties to a hard surface by applying thereto a composition containing an associative polymeric thickening agent and a particular surfactant containing ethylene oxide.

RELATED BACKGROUND ART

There are many applications where it is desirable to render a hard surface hydrophilic or to enhance the hydrophilic properties of a hard surface. For example, it is desirable for a mirror surface not to fog up under conditions of high humidity such as in a shower stall or in a bathroom. As another example, a boat hull would better maintain a shiny glossy appearance if water drained off the surface in a sheet rather than remaining on the surface as agglomerated droplets. Similarly, automobile finishes would appear cleaner after washing if the residue water did not dry as individual droplets on the surface but instead dried as a uniform sheet.

In another application, a hydrophilic surface would provide more efficient movement through a water medium because the surface boundary layer would not detach as readily from the surface. Such better controlled boundary layers reduces turbulence, thereby increasing efficiency. Thus, the formation of a hydrophilic layer or film on a boat surface would desirably make the surface more "slippery" while moving through water.

Similarly, water discharged through a confined channel such as a hose could be discharged at a higher rate for a given head pressure if the water flow were less turbulent in the hose. The formation of a hydrophilic layer at the water/channel interface would improve the hydrodynamic characteristics of such discharges, thereby allowing water to be pumped farther and/or with greater volume through a given hose.

Such hydrophilic properties can also provide anti-static effects that allow the hydrophilic surface to remain clean longer because ionic dust particles are less attracted to the surface. Thus, it would be desirable to provide a composition that imparts or enhances anti-static properties to hard surfaces such as, for example, glass, furniture and floors. In particular, a composition which can be conveniently applied as, for example, a glass cleaning composition, a surface paste, or a continuously supplied fluid supplement to impart or enhance hydrophilic properties to a surface would be desirable.

Various glass cleaning compositions are well-known. For example, U.S. Pat. No. 5,750,482 describes a non-streaking glass cleaning composition containing ethylene glycol monohexyl ether and a surfactant in water together with a small amount of an organic co-solvent.

SUMMARY OF THE INVENTION

This invention is directed to a method of rendering a hard surface hydrophilic by applying to the surface a composition containing i) an associative polymeric thickening agent and ii) a compound represented by the following chemical structure:

(I)

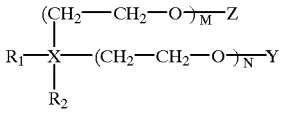

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene substituent, or nothing; $R_2$=H, $CH_3$, $C_2H_5$, a branched or unbranched $C_{8-22}$ alkyl or alkylene substituent, O, or nothing; X=N, O, S, P, Si, $PO_3$, or $SO_3$; and Y=$R_2$ when N=0.

This invention is also directed to a composition and a film formed from the residue of that composition. The composition contains i) an associative polymeric thickening agent and ii) a compound having the chemical structure (I) described above.

DETAILED DESCRIPTION OF THE INVENTION

The present invention is directed to a method of providing anti-fog, hydrophilic, water sheeting, and/or anti-static properties to a hard surface (and/or enhancing such properties) by applying a composition containing from about 0.01% to about 30% by weight of an associative polymeric thickening agent and from about 0.01% to about 55% by weight of a compound having the following chemical structure:

(I)

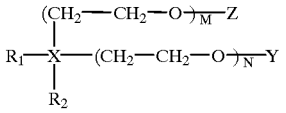

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene substituent, or nothing; $R_2$=H, $CH_3$, $C_2H_5$, a branched or unbranched $C_{8-22}$ alkyl or alkylene substituent, O, or nothing; X=N, O, S, P, Si, $PO_3$, or $SO_3$; and Y=$R_2$ when N=0. It is preferable that M equal N and each be from 5 to 10 (total of M+N=10 to 20).

The present invention is also directed to a method of forming a residual layer on a hard surface, and the thus formed surface layer, effective to provide or to enhance anti-fog, hydrophilic, water sheeting, and/or anti-static properties to the resulting coated surface, from the application of the composition described above containing i) an associative polymeric thickening agent and ii) a compound having the chemical structure (I) to the surface.

The hard surface can be any convenient firm surface, as will be clear from the following nonlimiting examples: glass, enameled metal, metal, painted wood, flexible polymeric surfaces, clear or opaque composite surfaces, fiberglass surfaces, glass or plastic bottles, metal or synthetic composition containers, rubber hoses, plastic window panes, shower curtains, and vinyl or aluminum siding.

All percentages herein are by weight unless specifically stated otherwise.

Associative polymeric thickeners are water-soluble or water-swellable polymers that have chemically attached hydrophobic groups that are capable of non-specific hydrophobic associations similar to those of conventional surfactants. Associative polymeric thickeners are also known as hydrophobically modified water soluble polymers. Any convenient associative polymeric thickener may be used such as, for example, the associative polymeric thickeners described in U.S. Pat. Nos. 5,652,208 and 5,648,326, the disclosures of which are incorporated herein by reference. The associative thickener is typically an addition polymer of three components: an alpha-beta-monoethylenically unsaturated monocarboxylic acid or dicarboxylic acid of from 3 to 8 carbon atoms such as acrylic acid or methacrylic acid to provide water solubility, a monoethylenically unsaturated copolymerizable monomer lacking surfactant capacity such as methyl acrylate or ethyl acrylate to obtain the desired polymer backbone and body characteristics, and a monomer possessing surfactant capacity which provides the pseudo plastic properties to the polymer and is the reaction product of a monoethylenically unsaturated monomer with a non-ionic surfactant compound wherein the monomer is copolymerizable with the foregoing monomers such as the reaction product of methacrylic acid with a monohydric nonionic surfactant to obtain a monomer such as $CH_3(CH_2)_{15-17}(OCH_2CH_2)_eOOCC(CH_3)=CH_2$ where "e" has an average value of about 10 or 20. An exemplary associative polymeric thickener that may be used is "ACUSOL 823," an acrylic polymer available from Rohm & Haas Co. (Philadelphia, Pa.).

In the present invention, the associative polymeric thickener is used in conjunction with compound (I) which can be described as a neutralizing agent or a non-ionic surfactant. The neutralization of an acrylic polymer by long chain amine functional neutralizing agents to improve the stability of hair spray resins is described by U.S. Pat. Nos. 4,874,604 and Re. 34,157, the disclosures of which are incorporated by reference herein. A preferred neutralizing agent is an ethoxylated cocoamine such as Varonic K-215, a PEG-15 cocoamine made by Witco Corporation (Dublin, Ohio) represented by the following chemical structure:

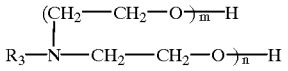

(II)

wherein the sum of m and n is 15; and $R_3$=coco. It is known in the art that "coco" represents $C_{10-20}$ linear and/or branched aliphatic substituents. In the case of Varonic K-215, the coco has a median distribution at $C_{12-14}$.

The composition of the present invention can conveniently include other components. Advantageously, the composition may include an anionic surfactant such as sodium lauryl sulfate. Further, the composition may include a fluorinated surfactant. Such anionic and fluorinated surfactants are described in U.S. Pat. No. 5,750,482, the disclosure of which is incorporated by reference herein. An example, of an anionic surfactant is Stepanol LCP (Stepan Co., Northfield, Ill.). An example of a fluorinated surfactant is Fluorad FC-129 (3M Co., St. Paul, Minn.).

The composition of this invention contains i) from about 0.01% to about 30% by weight of an associative polymeric thickening agent and ii) from about 0.01% to about 55% by weight of a compound represented by formula (I) in an aqueous solution. Other cosolvents may be included such as, for example, propylene glycol, isopropyl alcohol, an ethylene glycol n-hexyl ether such as hexyl cellosolve, an ethylene glycol n-butyl ether such as butyl cellosolve, or any other convenient co-solvent.

Other additives such as dyes or colorants, perfumes or an inorganic neutralizing agent such as ammonium hydroxide can be conveniently included.

Without being bound to theory, it is believed that the residue from the applied composition of this invention forms a hydrophilic layer on the applied surface. The hydrophilic properties of the layer derive from the pendant hydroxyl groups and the oxygen groups extending outward from the layer. Other advantageous properties imparted by the layer derive from the layer filling voids and microfissures common to hard surfaces. By filling such surface faults and roughness, the layer smoothens the surface. Further, the layer covers sharp peak features in such surfaces. It is believed that such sharp peak features provide nucleating sites where water aggregates form. The thus formed water aggregates in their smaller size ranges undesirably fog surfaces while in their larger ranges undesirably form droplets.

Accordingly, the present invention forms a residual layer effective to provide anti-fogging properties, resistance to surface droplet formation properties, hydrophilic properties, smoothing properties, or any combination of such properties, on the surface after the applied composition of the invention has substantially dried. The residual layer can be formed by any convenient method after applying the composition such as, for example, by allowing the composition to dry, by substantially wiping off the composition, by force drying the composition, or by calendaring or carding a predetermined thickness of the composition. In certain applications, multiple applications or layers might be required to achieve the desired property.

The composition can be applied by any convenient process such as, for example, spraying, wiping, pouring, or misting onto a surface. The surface can conveniently be brought into contact with the composition by, for example, dipping into the composition. The composition can be applied in any convenient form such as, for example, as a low viscosity liquid that can be sprayed, a higher viscosity liquid/gel that can be squeezed from a tube, or as a paste mixture that can be smeared from a cloth.

Further, the composition imparts enhanced performance at the fluid/solid interface of the composition with the solid to which the composition is in contact. Thus, the composition can be added as a concentrate to any convenient aqueous medium. Further, the composition can be applied as a concentrate to a surface that will be subjected to contact with liquid media.

The composition can advantageously be incorporated in products such as, for example, surface cleaners, waxes, or polishes to add hydrophilic, anti-fog, water sheeting, or anti-static properties to surfaces. Anti-static properties benefit from the addition of ions to the aqueous composition to facilitate charge transfer. For example, NaCl can be added.

When used as a surface cleaner such as a glass cleaner, the composition of this invention can conveniently be more dilute. When used as a furniture or floor polish, the composition of this invention can conveniently be more concentrated. When used as a boat hull performance enhancer, the composition of this invention can conveniently be even more concentrated forming a paste. In such paste form, some components may be not completely dissolved in the liquid phase. Nonetheless, the term solution as used herein includes such mixtures.

In a particular surface cleaner application, a water-sheeting surface cleaner, the composition of this invention is incorporated in a product such as, for example, a shower surface cleaner. The hydrophilic and water-sheeting properties imparted or enhanced by this composition causes water droplets remaining after a shower to drain away —leaving behind a generally uniform, thin, aqueous film that then dries. In use, a water-sheeting surface cleaner is applied to a surface that is subjected to water-borne soil such as, for example, surfaces in a shower or bath enclosure. The water-sheeting surface cleaner is applied proximate in time after the surface has been subjected to water-borne soil such as, for example, after a shower or bath. No scrubbing is necessary, and it is preferable that the surfaces not be rinsed after application of the water-sheeting surface cleaner thereto. After repeated cycles of such use of a water-sheeting surface cleaner after a shower/bath, the shower/bath surfaces are left clean, and the glossy shower/bath surfaces are left shiney, without scrubbing or rinsing.

Without being bound to theory, it is believed that the cleaning action, without rinsing, of the water-sheeting surface cleaner composition of this invention is based on the following phenomena. Water-borne soil, as found for example after a shower or a bath, includes water-insoluble and water soluble dirt. When an effective amount of a water-sheeting surface cleaner is applied to a wet surface, the water component of the cleaner combines with the water on the surface to form a substantially contiguous aqueous sheet on the surface (the water-sheeting action). A sheet of water, having a lower boundary wall/volume ratio, cannot maintain a water column height (water sheet thickness) as high as that maintainable by a droplet, particularly when the water sheet is on a hydrophilic surface. Thus, excess water drains leaving behind a thin aqueous film. The draining water washes away a portion of the insoluble dirt as well as a portion of the soluble dirt. The dirt that remains is composed of a portion of insoluble dirt and that small amount of dirt dissolved in the remaining thin aqueous film. That small amount of dissolved dirt is evenly dispersed because of the sheeting action and consequently is less perceptible than if distributed as a multitude of concentrated spots. Further, as the aqueous film dries, a layer is formed on the surface that enhances or imparts hydrophilic properties to the surface. The aqueous film also helps prevent particulates from finding a purchase-hold on the shower surface. Thus, repeated use cycles will further lessen the amount of insoluble dirt left behind by the draining water because the surface will be more hydrophilic. The aqueous film, being thin, further limits the amount of dissolved material that can remain to soil the shower surface. Accordingly, repeated use cycles will leave the surfaces such as, for example, tile, ceramic, chrome, glass, and plastic, including surfaces of fixtures, clean without scrubbing or rinsing.

In use, the water-sheeting surface cleaner is sprayed or misted on to the surfaces after an activity that leaves water droplets on the surface or that generally leaves the surface wet. Such activities include showering or bathing. The water-sheeting surface cleaner is dispensed from any convenient dispenser such as a hand-operated sprayer or mister. In use, an effective amount of the composition of this invention is applied to cause the surface water to drain while forming an aqueous film on the surface. The composition should be applied at a rate of from about 1 g to about 20 g per square meter, although an insufficient amount would be generally evidenced by the water not sheeting and more water-sheeting surface cleaner can be then applied, while an excessive amount would generally be just drained off and be wasted without detriment to the surface.

In an application as a surface cleaner, the aqueous composition of this invention preferably contains the associative polymeric thickening agent in an amount from about 0.01% to about 2.0% by weight of the total aqueous composition, more preferably from about 0.02% to about 1.0% by weight of the total aqueous composition, and even more preferably from about 0.05% to about 0.5% by weight of the total aqueous composition. As a surface cleaner, the composition preferably contains the compound represented by formula (I) in an amount from about 0.05% to about 5.0% by weight of the total aqueous composition, more preferably from about 0.10% to about 2.0% by weight of the total aqueous composition, and even more preferably from about 0.20% to about 1.0% by weight of the total aqueous composition.

The associative polymeric thickening agent can be conveniently added as a 30% actives aqueous solution. The compound represented by formula (I) can be conveniently added in 100% actives neat form.

This invention also forms a surface layer from the residue of the above surface cleaner composition. The surface cleaner composition can be applied by any convenient method such as, for example, by spraying, flooding, soaking, or wiping. The residue surface layer can be formed by any convenient method such as, for example, by allowing the applied composition to dry, by wiping off a substantial amount of the applied composition, or by squegeeing the applied composition. Heat can be conveniently used to speed drying and form a film.

In a preferred embodiment of the invention, a surface cleaner may contain about 0.01–0.5 wt % Acusol 823, about 0.01–1.0 wt % Varonic K-215, about 0–0.2 wt % propylene glycol, about 0–2.0 wt % ammonium hydroxide, about 0–5.0 wt % Stepanol LCP, about 0–1.0 wt % Ethylene glycol n-hexyl ether, about 0–1.0 wt % Ethylene glycol n-butyl ether, about 0–0.1 wt % Fluorad FC-129, about 0–1.0 wt % colorant, about 0–1.0 wt % fragrance oil, and the remainder being water.

Varonic K-215 is an ethoxylated cocoamine, also known as PEG-15 cocoamine, available from the Witco Corporation (Dublin, Ohio). Varonic DM-55 is a solvent having the formula Me—(—O—C—C—)$_{5.5}$—O—Me available from the Witco Corporation.

Stepanol LCP is 30% active sodium lauryl sulfate available from Stepan Co., Northfield, Ill.

Fluorad FC-129 is $R_fSO_2N(C_2H_5)CH_2CO_2^-K^+$, a fluorosurfactant, available from 3M Company (St. Paul, Minn.).

Neodol 23-6.5 is a nonionic surfactant available from Shell Chemical Co. (Houston, Tex.).

In a paste form, the composition of this invention preferably contains the associative polymeric thickening agent in an amount from about 1.0% to about 20% by weight of the paste, more preferably from about 2% to about 15% by weight of the paste, and even more preferably from about 2% to about 10% by weight of the paste; and preferably contains the compound represented by formula (I) in an amount from about 1.0% to about 50% by weight of the paste, more preferably from about 2% to about 30% by weight of the paste, and even more preferably from about 3% to about 25% by weight of the paste.

The composition of the present invention can also be added as a fluid performance enhancer to improve flow properties when the fluid is pumped through a confined outlet such as a hose. In such applications, the composition can be added to the fluid to form a performance enhanced fluid prior to the performance enhanced fluid being pumped. The performance enhanced fluid preferably contains the associative polymeric thickening agent in an amount from about 0.001 wt % to about 2.0 wt % of the performance enhanced fluid, more preferably from about 0.01 wt % to about 1.0 wt % of the performance enhanced fluid, and even more preferably from about 0.01 wt % to about 0.05 wt % of the performance enhanced fluid. The performance enhanced fluid preferably contains the compound represented by formula (I) in an amount from about 0.001 wt % to about 5.0 wt % of the performance enhanced fluid, more preferably from about 0.01 wt % to about 2.0 wt % of the performance enhanced fluid, and even more preferably from about 0.01 wt % to about 1.0 wt % of the performance enhanced fluid.

The composition of this invention can also be added to the fluid as the fluid is being pumped. In that case, the composition should be added to the fluid at a rate effective to cause the thus formed performance enhanced fluid to contain the above recited amounts of the associative polymeric thickening agent and the compound represented by formula (I). Preferably, the composition should be added at a rate to form a resulting concentration of about 0.001 wt % to about 5 wt %, preferably from about 0.01 wt % to about 0.05 wt %.

This invention also forms a surface layer from the residue of any of the above compositions of this invention. The paste composition can be applied by any convenient method such as, for example, by smearing, wiping, pouring, or spraying. The residue surface layer can be formed by any convenient method such as, for example, by allowing the applied composition to dry, by wiping off a substantial amount of the applied composition, or by squegeeing the applied composition. Heat can conveniently be applied to dry the solvent in order to form the residue surface layer.

EXAMPLES

The Examples which follow are intended as an illustration of certain preferred embodiments of the invention, and no limitation of the invention is implied.

Examples 1–3

Anti-fog surface cleaners were made by mixing the following ingredients together:

| | Ex. 1 | Ex. 2 | Ex. 3 |
|---|---|---|---|
| Acusol 823 (30% actives) | 0.2% | 0.2% | 0.2% |
| Varonic K-215 | 0.36% | 0.36% | 0.36% (amine oxide) |
| Stepanol LCP (30% actives) | 0.33% | 0.33% | 0.33% |
| Fluorad FC-129 | 0.0125% | 0.0125% | 0.0125% |
| propylene glycol | 0.125% | 0.125% | 0.125% |
| ethylene glycol n-butyl ether | 0.80% | — | 0.80% |
| ethylene glycol n-hexyl ether | 0.60% | 0.60% | 0.60% |
| 28% ammonium hydroxide | 0.43% | 0.30% | 0.43% |
| Fragrance | 0.04% | 0.04% | 0.04% |
| deionized water | Remainder | Remainder | remainder |

Example 3 used an amine oxide version of Varonic K-215. The resulting solutions were each water clear with pH of about 10.6. The solutions performed very well in anti-fogging tests, producing 0% fogging.

Samples were tested for their anti-fogging properties as follows. A glass mirror was cleaned by first using a commercial glass cleaner rubbed vigorously over the mirror with a cheesecloth. The mirror was then dried with a commercial wipe. Next, the surface was flooded with deionized water and again rubbed vigorously with a cheesecloth followed by drying with a commercial wipe.

The clean mirror was then placed on a clean dry flat surface. Two standardized sprays were directed from 6 inches above the mirror towards the center of the mirror. A standard commercial paper towel, folded in quarter (by folding in half twice) was then wiped lightly from side to side and top to bottom two times each direction. The towel was then flipped over and the wiping was repeated until the mirror was dry.

The thus treated mirror was held at a 20° angle to a light source to evaluate any post application streaking.

Examples 1–3 of this invention did not show streaking.

A Steam Valet™ (Sunbeam-Oster Household Products Co. (Laurel, Miss.), a standard commercial steamer typically used to remove wrinkles from clothes without ironing, was held from the treated mirror at a 20° angle and the steam control was activated to cover the entire surface in steam for 5–10 sec. The steam was then stopped and the mirror evaluated for fogging. In evaluating, three factors were considered: (i) Is the mirror fogged? (ii) What percentage of the surface is fogged? and (iii) Is the mirror clear and free of distortion?

Examples 1–3 of this invention did not show any fogging. The term 0% fogging refers to the percentage (zero) of the mirror surface fogged. The mirror remained clear and free of distortion.

The treated mirrors were further allowed to air dry thoroughly and reevaluated for post fog streaking. This reevaluation was similarly performed by holding the mirror at a 20° to a light source and inspecting for visible streaking or hazing.

Examples 1–3 of this invention did not show any post-steaming streaking or hazing.

Examples 4–18

Examples 4–18 of the invention were made by mixing together at room temperature the components shown in the tables below. All quantities are in wt %. In all cases the ammonium hydroxide was added last.

| | Ex. 4 | Ex. 5 | Ex. 6 | Ex. 7 | Ex. 8 | Ex. 9 | Ex. 10 | Ex. 11 | Ex. 12 | Ex. 13 |
|---|---|---|---|---|---|---|---|---|---|---|
| Neodol 23-6.5 | 0.2000 | 0.2000 | 0.2000 | 0.2000 | 0.1000 | — | — | — | — | — |
| Varonic K-215 | 0.3600 | 0.3600 | 0.3600 | 0.3600 | 0.3600 | 0.3600 | 0.3600 | 0.3600 | 0.2500 | 0.3600 |
| Varonic DM-55 | 0.8000 | — | 0.6000 | — | — | — | — | — | — | — |
| Fragrance | 0.0400 | 0.0400 | 0.0400 | 0.0400 | 0.0400 | 0.0400 | 0.0400 | 0.0400 | 0.0400 | 0.0400 |
| Acusol 823 (30% actives) | 0.4000 | 0.2000 | 0.2000 | 0.2000 | 0.2000 | 0.2000 | 0.1000 | 0.1000 | 0.1000 | 0.2000 |
| Stepanol LCP (30% actives) | 0.3400 | 0.3300 | 0.1500 | 0.1500 | 0.1500 | 0.3300 | 0.3300 | 0.1500 | 0.1600 | 0.2700 |

-continued

| | | | | | | | | | | |
|---|---|---|---|---|---|---|---|---|---|---|
| Fluorad FC-129 | 0.0125 | 0.0125 | 0.0125 | 0.0125 | 0.0125 | 0.0125 | 0.0125 | 0.0125 | 0.0125 | 0.0125 |
| Propylene glycol | 0.1250 | 0.0125 | 0.1250 | 0.1250 | 0.1250 | 0.1250 | 0.2250 | 0.1250 | 0.1400 | 0.1250 |
| Ethylene glycol n-butyl ether | 0.8000 | 0.8000 | 0.8000 | 0.8000 | 0.8000 | 0.8000 | 0.8000 | 0.8000 | 0.8000 | 0.8000 |
| Ethylene glycol n-hexyl ether | — | 0.6000 | — | 0.6000 | 0.6000 | 0.6000 | 0.6000 | 0.6000 | 0.6000 | 0.6000 |
| Borax ($Na_2B_4O_710H_2O$) 5 molar | 0.2000 | 0.2000 | 0.1000 | 0.1000 | 0.0500 | — | — | — | — | — |
| 28% ammonium hydroxide | 0.4300 | 0.4300 | 0.4300 | 0.4300 | 0.4300 | 0.4300 | 0.4300 | 0.4300 | 0.4300 | 0.4300 |
| Deionized water | | | | | remainder | | | | | |

| | Ex. 14 | Ex. 15 | Ex. 16 | Ex. 17 | Ex. 18 |
|---|---|---|---|---|---|
| Neodol 23-6.5 | — | — | — | — | — |
| Varonic K-215 | 0.3600 | 0.3600 | 0.3600 | 0.3600 | 0.4500 |
| Varonic DM-55 | — | — | — | — | — |
| Fragrance | 0.0400 | 0.0400 | 0.0400 | 0.0400 | 0.0400 |
| Acusol 823 (30% actives) | 0.2000 | 0.2000 | 0.2000 | 0.2000 | 0.2000 |
| Stepanol LCP (30% actives) | 0.2100 | 0.1500 | 0.1000 | 0.0500 | 0.0500 |
| Fluorad FC-129 | 0.0125 | 0.0125 | 0.0125 | 0.0125 | 0.0125 |
| propylene glycol | 0.1250 | 0.1250 | 0.1250 | 0.1250 | 0.1250 |
| ethylene glycol n-butyl ether | 0.8000 | 0.8000 | 0.8000 | 0.8000 | 0.8000 |
| ethylene glycol n-hexyl ether | 0.6000 | 0.6000 | 0.6000 | 0.6000 | 0.6000 |
| Borax ($Na_2B_4O_710H_2O$) 5 molar | — | — | — | — | — |
| 28% ammonium hydroxide | 0.4300 | 0.4300 | 0.4300 | 0.4300 | 0.4300 |
| deionized water | | | remainder | | |

Examples 5, 8, and 9 were tested against a comparative example of a commercially available anti-fog glass cleaner (Comp. Ex. 1). The average results of four runs from ten testers are as follows:

Comp. Ex. 1 11.5% covered with fogging

Ex. 4 0.0% covered with fogging

Ex. 7 0.3% covered with fogging

Ex. 8 1.4% covered with fogging

The results show that the Examples of this invention consistently performed better than the commercial comparative example.

Other variations and modifications of this invention will be apparent to those skilled in this art after careful study of this application. This invention is not to be limited except as set forth in the following claims.

What is claimed is:

1. A surface cleaning composition comprising:

(i) about 0.01% to about 30% by weight of the total composition of an associative polymeric thickening agent formed from the monomers acrylic acid, alkyl acrylate, and an acrylate ester of a nonionic surfactant and acrylic acid; and (ii) about 0.01% to about 55% by weight of the total composition of a compound represented by the chemical structure:

(I)

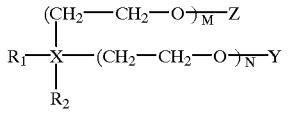

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene, or nothing; $R_2$=H, $CH_3$, $C_2H_5$, a branched or unbranched $C_{8-22}$ alkyl or alkylene, O, or nothing; X=N, O, P, Si, $PO_3$, or $SO_3$; and Y=$R_2$ when N=0, and wherein the composition is effective to impart or enhance hydrophilic and anti-fogging properties to the surface.

2. The composition according to claim 1, wherein M equals N and each is an integer from 5 to 10.

3. The composition according to claim 1, wherein said compound represented by the chemical structure (I) is an ethoxylated cocoamine represented by the chemical structure:

(II)

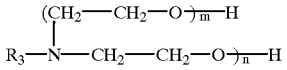

wherein the sum of m and n is 15; and $R_3$=coco.

4. The composition according to claim 1, wherein said associative polymeric thickening agent is in the amount from about 0.01 wt % to about 2.0 wt %.

5. The composition according to claim 1, wherein said compound (I) is in the amount from about 0.05 wt % to about 5.0 wt %.

6. The composition according to claim 1 further including an anionic surfactant, a fluorinated surfactant, or a mixture thereof.

7. The composition according to claim 1 further including a solvent comprising water, isopropyl alcohol, propylene glycol, an ethylene glycol n-hexyl ether, an ethylene glycol n-butyl ether, or a mixture thereof.

8. A surface cleaning composition comprising:

(i) about 0.01% to about 30% by weight of the total composition of an associative polymeric thickening agent formed from the monomers acrylic acid, alkyl acrylate, and an acrylate ester of a nonionic surfactant and acrylic acid; and (ii) about 0.01% to about 55% by weight of the total composition of a compound represented by the chemical structure:

(I)

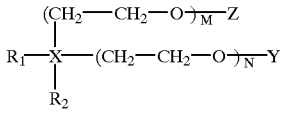

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene, or nothing; $R_2$=H, $CH_3$, $C_2H_5$, a branched or unbranched $C_{8-22}$ alkyl or alkylene, O, or nothing; X=N, O, P, Si, $PO_3$, or $SO_3$; and Y=$R_2$ when N=0, and wherein the composition is effective to impart or enhance anti-static and anti-fogging properties to the surface.

9. The composition of claim 8 wherein the compound (I) is an ethoxylated cocoamine wherein Z=H, Y=H, the sum of M and N is 15, $R_1$=coco, $R_2$=nothing, and X=N.

10. The composition of claim 8 wherein the associative polymeric thickening agent is in the amount from about 0.01 wt % to about 2.0 wt %.

11. The composition of claim 8 wherein the compound (I) is in the amount from about 0.05 wt % to about 5.0 wt %.

12. The composition of claim 8 further including an anionic surfactant, a fluorinated surfactant, or a mixture thereof.

13. The composition of claim 8 further including a solvent comprising water, isopropyl alcohol, propylene glycol, an ethylene glycol n-hexyl ether, an ethylene glycol n-butyl ether, or mixture thereof.

14. A surface cleaning composition comprising:

(i) about 0.01% to about 30% by weight of the total composition of an associative polymeric thickening agent formed from the monomers acrylic acid, alkyl acrylate, and an acrylate ester of a nonionic surfactant and acrylic acid; and (ii) about 0.01% to about 55% by weight of the total composition of a compound represented by the chemical structure:

(I)

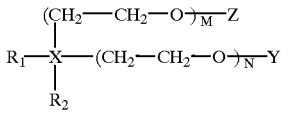

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene, or nothing; $R_2$=H, $CH_3$, $C_2H_5$, a branched or unbranched $C_{8-22}$ alkyl or alkylene, O, or nothing; X=N, O, P, Si, $PO_3$, or $SO_3$; and Y=$R_2$ when N=0, and wherein the composition is effective to impart or enhance anti-static and anti-fogging properties to the surface.

15. The composition of claim 14 wherein the compound (I) is an ethoxylated cocoamine wherein Z=H, Y=H, the sum of M and N is 15, $R_1$=coco, $R_2$=nothing, and X=N.

16. The composition of claim 14 wherein the associative polymeric thickening agent is in the amount from about 0.01 wt % to about 2.0 wt %.

17. The composition of claim 14 wherein the compound (I) is in the amount from about 0.05 wt % to about 5.0 wt %.

18. The composition of claim 14 further including an anionic surfactant, a fluorinated surfactant, or a mixture thereof.

19. The composition of claim 14 further including a solvent comprising water, isopropyl alcohol, propylene glycol, an ethylene glycol n-hexyl ether, an ethylene glycol n-butyl ether, or mixture thereof.

20. A surface cleaning composition comprising:

(i) about 0.01% to about 30% by weight of the total composition of an associative polymeric thickening agent formed from the monomers acrylic acid, alkyl acrylate, and an acrylate ester of a nonionic surfactant and acrylic acid; and (ii) about 0.01% to about 55% by weight of the total composition of a compound represented by the chemical structure:

(I)

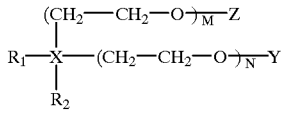

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene, or nothing; $R_2$=H, $CH_3$, $C_2H_5$, a branched or unbranched $C_{8-22}$ alkyl or alkylene, O, or nothing; X=N, O, P, Si, $PO_3$, or $SO_3$; and Y=$R_2$ when N=0, and wherein the composition is effective to impart or enhance anti-static and anti-fogging properties to the surface.

21. The composition of claim 20 wherein the compound (I) is an ethoxylated cocoamine wherein Z=H, Y=H, the sum of M and N is 15, $R_1$=coco, $R_2$=nothing, and X=N.

22. The composition of claim 20 wherein the associative polymeric thickening agent is in the amount from about 0.01 wt % to about 2.0 wt %.

23. The composition of claim 20 wherein the compound (I) is in the amount from about 0.05 wt % to about 5.0 wt %.

24. The composition of claim 20 further including an anionic surfactant, a fluorinated surfactant, or a mixture thereof.

25. The composition of claim 20 further including a solvent comprising water, isopropyl alcohol, propylene glycol, an ethylene glycol n-hexyl ether, an ethylene glycol n-butyl ether, or mixture thereof.

26. A fluid performance enhancing composition comprising:

(i) about 0.01% to about 30% by weight of the total composition of an associative polymeric thickening agent formed from the monomers acrylic acid, alkyl acrylate, and an acrylate ester of a nonionic surfactant and acrylic acid; and (ii) about 0.01% to about 55% by weight of the total composition of a compound represented by the chemical structure:

(I)

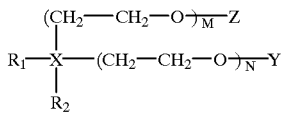

wherein Z=H, $CH_3$, or $C_2H_5$; Y=H, $CH_3$, or $C_2H_5$; M=1 to 30; N=0 to 30; $R_1$=H, $CH_3$, $C_2H_5$, a branched or unbranched $C_{8-22}$ alkyl or alkylene, or nothing; $R_2$=H, $CH_3$, $C_2H_5$, a branched or unbranched $C_{8-22}$ alkyl or alkylene, O, or nothing; X=N, O, P, Si, $PO_3$, or $SO_3$; and Y=$R_2$ when N=0, and wherein the composition is effective to impart or enhance anti-static and anti-fogging properties to the surface.

27. The composition of claim 26 wherein the compound (I) is an ethoxylated cocoamine wherein Z=H, Y=H, the sum of M and N is 15, $R_1$=coco, $R_2$=nothing, and X=N.

28. The composition of claim 26 wherein the associative polymeric thickening agent is in the amount from about 0.01 wt % to about 2.0 wt %.

29. The composition of claim 26 wherein the compound (I) is in the amount from about 0.05 wt % to about 5.0 wt %.

30. The composition of claim 26 further including an anionic surfactant, a fluorinated surfactant, or a mixture thereof.

* * * * *

UNITED STATES PATENT AND TRADEMARK OFFICE

CERTIFICATE OF CORRECTION

PATENT NO. : 6,403,545 B1 
DATED : June 11, 2002
INVENTOR(S) : Joseph F. Karls and John A. Sramek It is certified that error appears in the above-identified patent and that said Letters Patent is hereby corrected as shown below:

Column 11,
Lines 54 and 55, replace “impart or enhance anti-static and” with -- provide --

Column 12,
Line 30, replace “anti-static” with -- water-sheeting --

Column 13,
Lines 7-9, replace “impart or enhance anti-static and anti-fogging properties to the surface” with -- improve flow properties of a fluid when the fluid is pumped through a confined outlet. --

Signed and Sealed this

Twenty-ninth Day of June, 2004

JON W. DUDAS
*Acting Director of the United States Patent and Trademark Office*